United States Patent [19]

Klebe et al.

[11] 4,095,375

[45] Jun. 20, 1978

[54] SUPPORT ASSEMBLY FOR A PORTABLE SURFACE-TREATING MACHINE

[75] Inventors: Elmer C. Klebe, Easley; Edward N. Greene, Pickens, both of S.C.

[73] Assignee: The Singer Company, New York, N.Y.

[21] Appl. No.: 777,998

[22] Filed: Mar. 16, 1977

[51] Int. Cl.[2] ..... B24B 23/04

[52] U.S. Cl. ..... 51/170 MT

[58] Field of Search ..... 51/170 MT, 170 TL, 170 R

[56] References Cited

U.S. PATENT DOCUMENTS

| | | | |
|---|---|---|---|
| 3,665,654 | 5/1972 | Flack | 51/170 MT |
| 3,793,776 | 2/1974 | Sadow, Jr. | 51/170 MT |
| 3,849,943 | 11/1974 | Thomas | 51/170 MT |
| 3,862,520 | 1/1975 | Klebe, Jr. | 51/170 MT |

*Primary Examiner*—Harold D. Whitehead

*Assistant Examiner*—Roscoe V. Parker

*Attorney, Agent, or Firm*—Harold Weinstein; Robert E. Smith; Edward L. Bell

[57] ABSTRACT

An electrically driven portable surface-treating machine having the motor and means driven thereby for oscillating a platen mounted within a clam shell housing. The oscillatable platen is connected to the housing through securement of a plurality of hollow resilient posts. The upper end of the posts are connected to the housing by flanges which are retained within recesses formed transversely in the housing and there are pairs of such posts at respective ends of the housing, a flange of each pair of posts being in abutting relationship. The lower end of the posts are secured by self-tapping screws passing downwardly through the hollow posts to be threadedly received in the backing plate of the platen.

4 Claims, 10 Drawing Figures

SUPPORT ASSEMBLY FOR A PORTABLE SURFACE-TREATING MACHINE

BACKGROUND OF THE INVENTION

It has been known heretofore to provide electrically driven portable surface-treating machines such as sanders, polishers, buffers and the like with an oscillatable platen which is connected to the housing of the machine through the securement to a plurality of resilient posts. In the past, whether the post was mechanically connected at one or both ends, either metal inserts were required or external brackets were used to hold the adjacent pairs of resilient posts in position. This resulted in increased costs and a more complex structure leading to assembly difficulties.

SUMMARY OF THE INVENTION

It is an object of the invention to provide an improved support assembly for a portable surface-treating machine which overcomes the prior art disadvantages; which is simple, economical and reliable; which uses resilient posts not requiring additional inserts; which uses hollow resilient posts connected directly to the platens via self-tapping screws; which uses pairs of resilient posts having flanged tops readily mounted in self locking position within the clam shell housing; and which uses a counter-weighted fan to balance the vibratory motion transmitted from the housing and carried by the resilient posts to the platen.

Other objects and advantages will be apparent from the following description of one embodiment of the invention and the novel features will be particularly pointed out hereinafter in the claims.

BRIEF DESCRIPTION OF THE DRAWINGS

This invention is illustrated in the accompanying drawings in which.

DESCRIPTION OF THE INVENTION

Figure 1:
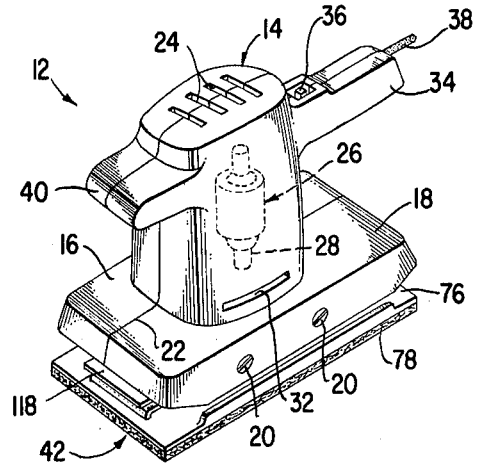
FIG. 1 is a perspective view of a surface-treating machine embodying the present invention.
Figure 2:
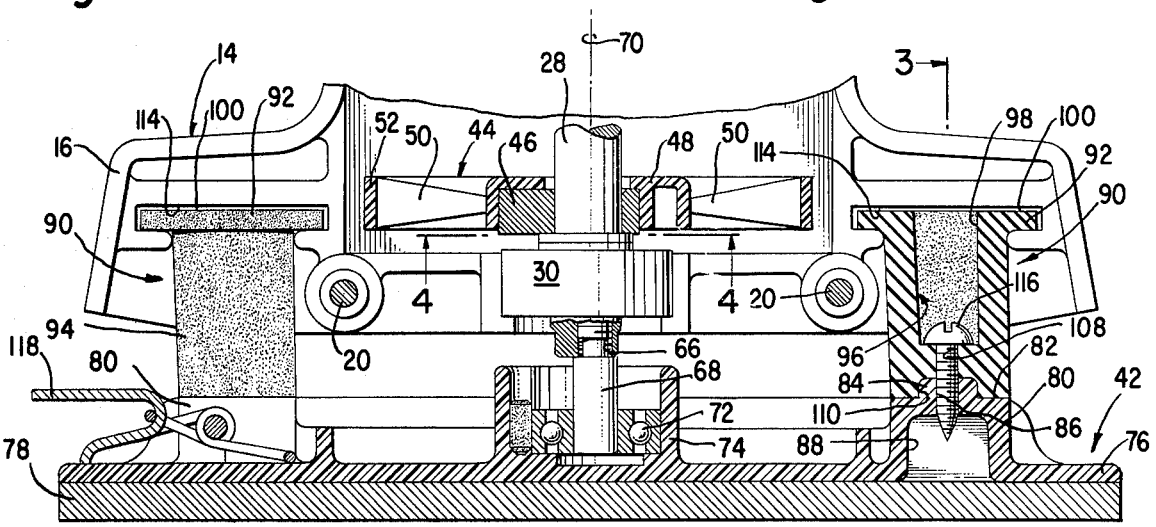
FIG. 2 is an enlarged side elevational view, in section, of the lower housing portion of the machine shown in FIG. 1.

Referring to FIGS. 1 and 2, there is shown an electrically driven portable surface-treating machine, designated generally 12, which is depicted as a sander. The machine is provided with a clam shell housing 14 having a pair of complimentary halves 16 and 18 which are detachably connected by fastening means such as carriage bolts 20 suitably spaced to assure close mating of the shell halves 16 and 18 along a longitudinal split 22. The sander 12 is provided with slots 24 for the entry of cooling air for a motor 26 having an armature 28 which is journalled in the housing 14 via spaced bearings 30, one of which is shown in FIG. 2. A lower slot 32 serves to exit the ventilating air from the housing 14. A handle 34 is illustrated in FIG. 1 as being formed integrally with the housing 14 and carries an electric switch 36 by which the operator can energize the motor 26 when the line 38 is connected with a source of electric power (not shown). An auxiliary handle 40 is integrally formed in the upper forward portion of the housing 14 so that the sander 12 can be grasped by the operator with both hands for easy manual control. An oscillatable platen sub-assembly 42 is connected to the housing at the bottom thereof. It will be understood that depending on the type of motion translation means used in the sander 12 the platen assembly can partake of reciprocatory or orbital motion as desired, with the latter being depicted in the present case.

Figure 4:
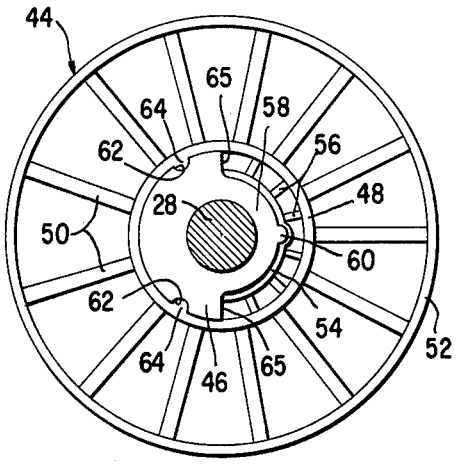
FIG. 4 is a bottom plan view of the counter-weighted fan taken along line 4—4 of FIG. 2.

A fan 44 is connected to a counter-weight bushing 46 by a hub 48 integrally formed on the fan 44 with the blades 50 extending radially in spaced relationship between the outer annular wall of hub 48 and a outer annular rim 52 illustrated in FIGS. 2 and 4. The top and bottom edges of the blades 50 taper inwardly from the rim in the direction of the hub 48 and have a smaller axial dimension at the hub 48. The hub 48 has a semi-circular inner wall 54 supported by ribs 56 disposed between the inner wall 54 and outer wall of hub 48 and extending half way around. The counter-weight 46 is nonrotatably affixed to the armature shaft 28 as shown in FIGS. 2 and 4 above the bearing 30 and has a narrow arcuate portion 58 which abuts the inner wall 54 and has a projection 60 which nests within a recess formed in the inner wall 54. The remaining portion of the counter-weight 46 is enlarged to abut the outer wall of the hub 48 and has a pair of recesses 62 which receive projections 64 formed on the interior of the outer wall of hub 48 so as to prevent slipping between the counter-weight 46 and hub 48 during rotation of the armature shaft 28. The counter-weight 46 may be force-fitted upon the shaft 28, while the fan 44 will be likewise force-fitted upon the counter-weight 46. The counter-weight 46 will act to balance the vibratory loads of the sander 12 so as to facilitate operation thereof without detracting from the oscillation of the platen 42. The counter-weight 46 defines a small radius on its narrow portion 58 which is substantially on one-half its distance and then radially increases as at 65, 65 to a larger radius for its remaining area. The small radius of the counter-weight 46 is substantially equal to the radius if the inner wall 54, while the larger radius of the counter-weight 46 is substantially equal to the radius of the outer wall of the hub 48. Upon operation of the motor 26 the fan 44 will induce cooling air through inlet slots 24 for discharge through the exit slots 32.

The lower end of the armature shaft 28 projects below the bearing 30 and has an eccentric tapped hole 66 extending vertically upwardly therein to threadedly receive a pin 68 which is eccentrically positioned relative to the axis 70 of the armature shaft 28 so as to act as a crank upon rotation of the shaft 28.

The free end of the pin 68 is journalled in a ball bearing 72 which is connected within a hub 74 of the back plate 76 of the platen 42. The eccentrically mounted pin 68 on rotating with the armature shaft 28 will impart an oscillatory motion to the platen 42 upon operation of the motor 26.

Figure 3:
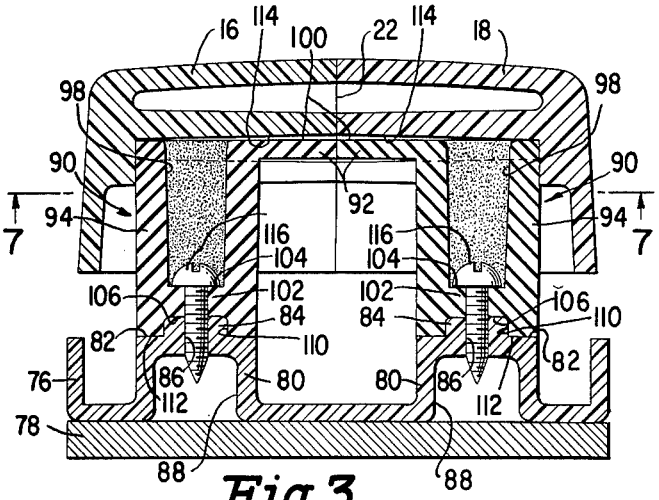
FIG. 3 is a sectional view taken along line 3—3 of FIG. 2.

The platen subassembly 42, illustrated in FIGS. 2 and 3, includes a resilient pad 78 which is bonded to the ridged back plate 76. Both the back plate 76 and the pad 78 are substantially planar in the area of their contact except for those small areas of the back plate 76 which are raised to form bosses 80. There are four bosses 80, each of which is small enough so as not to interfere with the planar position of the pad 78. The bosses 80 shown in FIGS. 2, 3 and 5 are raised upwardly from the top surface of the back plate 76 to terminate in a flat surface 82 having a smaller central annular projection 84 arising therefrom which have a central aperture 86 extending through the top of the boss 80 to communicate with the hollow interior 88 thereof.

Figure 5:
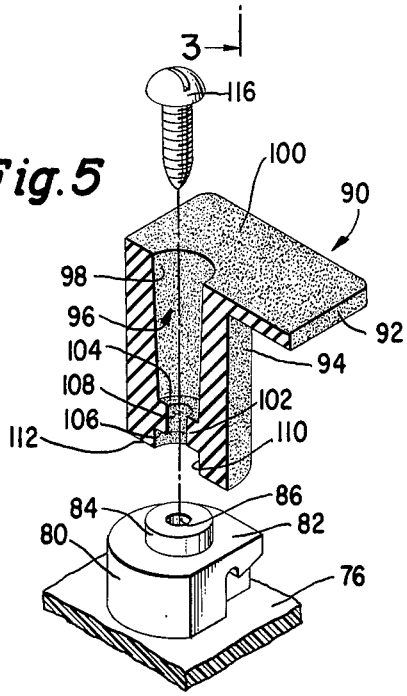
FIG. 5 is an exploded perspective view, partly in section, of an improved resilient hollow post prior to its being screw connected to the back plate of the platen.

In a plurality of resilient posts 90 shown best in FIG. 5 are used in complimentary pairs as illustrated in FIG. 3 to connect the platen assembly 42 with the housing 14 while permitting limited motion of the platen 42 relative the housing 14, which in the present case is of an oscillatory type. A pair of posts 90 will be located in front of and to the rear of the motor 26 as illustrated in FIG. 2. Each of the posts 90 is provided with a top flange 92 as shown in FIGS. 2, 3 and 5 of general rectangular configuration which extends from three sides of the top of a cylindrical body 94 with the mid extension being the greatest. The cylindrical body portion 94 has a hollow central aperture 96 extending therethrough. The aperture 96 has three sections; an upper section 98 which extends axially downwardly from the open top edge 100 of the flange 92 the greater length of the body 94 to terminate in an inwardly extending radial annular flange section 102 having an upper shoulder 104 and an lower shoulder 106 formed on either side of a reduced central opening 108, and a lower section 110 which extends from the lower shoulder 106 to a flat bottom edge 112. Each of the posts 90 are formed of a hard rubber or other suitable elastomer material which permits a controlled degree of flexibility thereof. The diameter of the lower section 110 is substantially equal to the diameter of the boss projection 84, while the axial distance of the lower section 110 also corresponds to the height of projection 84.

Each of the clam shell housing halves 16 and 18 is provided with a transversely extending, generally U-shaped recess 114 dimensioned to receive a top flange 92 of the post 90. The thickness of the flange 92 is such that upon assembly with the housing halves 16 and 18 the flange 92 will be received within the recess 114 preferably with a sliding fit between the flange 92 and the internal walls of the recess 114.

Each of the pairs of posts 90 will be disposed in the recess 114 with the body 94 entering first to be positioned adjacent the external wall and the flange 92 extending in the direction of the split 22 to abut against the adjacent flange 92 upon assembly of the housing halves 16 and 18 as best seen in FIG. 3. A self-tapping screw 116 illustrated in FIGS. 2, 3 and 5 will pass downwardly through the hollow aperture 96 of the body 94 to threadedly engage the hole 86 of boss 80 to connect the lower end of the resilient post 90 to the boss 80 of back plate 76. The lower section 110 will nest upon the projection 84 with the lower edge 112 resting upon the upper surface 82 for substantial complete contact of the upper surface of boss 80 and the lower surface of resilient post 90.

The assembly of the screw 116 from the top of the post 90 to connect the post 90 to the back plate 76 offers many advantages some of which are briefly set forth herein. The post 90 can be directly connected to the platen 76 without the need or requirement of any metal inserts, since the head of the screw bears directly upon shoulder 104 to seat the post 90 upon the back plate 76. The pad 78 remains a single solid sheet without the requirement of any openings or holes therein as was previously needed when the screw was connected from the underside of the platen. This permits greater uniform support of the sand paper sheet (not shown) affixed to the underside of the pad 78 via suitable clamps 118 shown in FIGS. 1 and 2. The back plate 76 can be molded of plastic which is cheaper and lighter and also facilitates the use of the self-tapping screws 116 which enter opening 86 to threadedly connect to the same with the pointed tip of the screw 116 safely positioned in the hollow 88.

Figure 6:
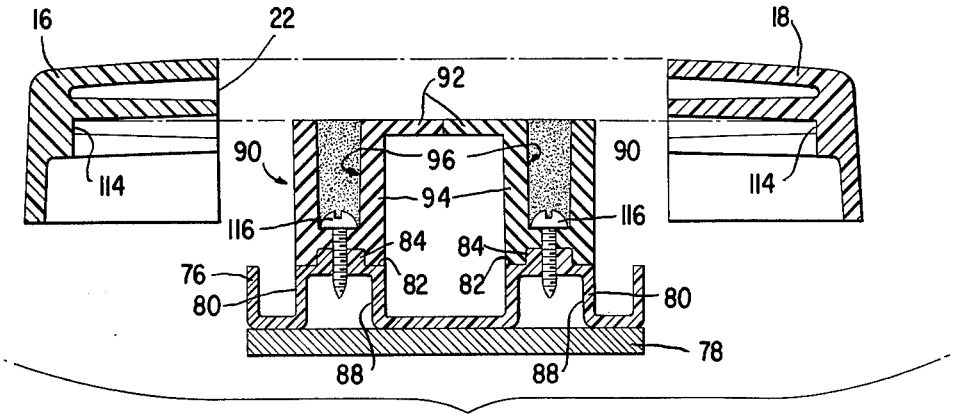
FIG. 6 is a front sectional view showing one method of assembling the improved support assembly wherein the posts are connected to the platen prior to assembling of the clam shell housing.
Figure 7:
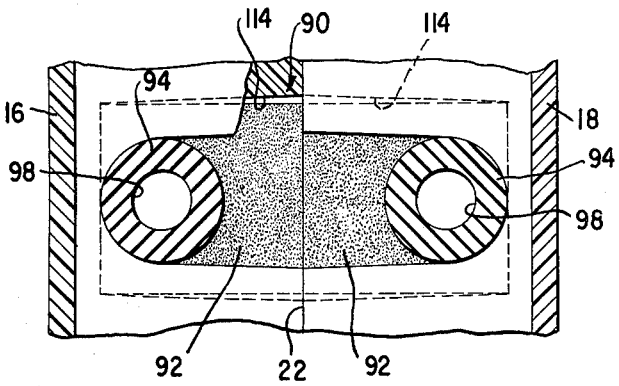
FIG. 7 is a bottom plan view of the posts wherein the flanges thereof are fitted within the recesses of the clam shell housing.
Figure 8:
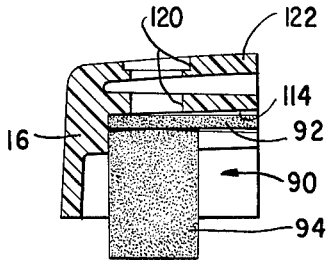
FIG. 8 is a front elevational view showing one of the posts fitted within the clam shell housing section having an access opening above the hollow of the posts.
Figure 9:
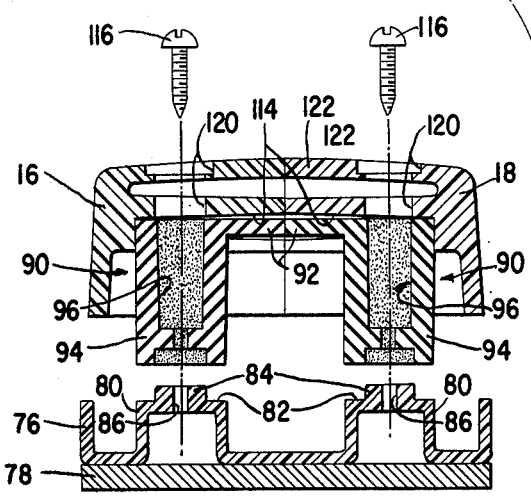
FIG. 9 is an exploded front sectional view showing another method of assembling the improved support assembly wherein the posts are connected in pairs within the clam shell housing prior to being screw connected to the platen through access openings in the housing.
Figure 10:
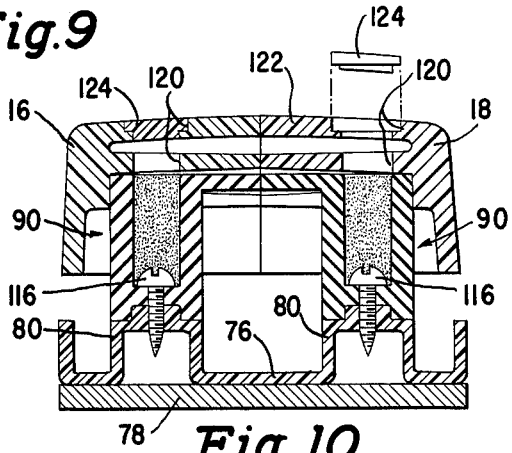
FIG. 10 shows caps fitted to close the access openings, one being assembled and the other shown in raised position.

In connecting the posts 90 to the platen 42 or housing 14 one method is shown in FIGS. 6 and 7, and another method is shown in FIGS. 8, 9 and 10. The methods disclosed are not exhaustive and other methods could be devised within the scope and intent of the present invention.

In FIG. 6 the post 90 are shown connected to the back plate 76 by the screws 116 first so as to position the pairs of resilient posts in aligned position with the opposite flanges 92 abutting. Subsequently the housing halves 16 and 18 will be slid in position and connected together to place the flanges 92 within the recesses 114 as is shown in FIG. 7.

Alternately, access openings 120 are formed to extend through the top deck 122 at locations in superposition to the apertures 96 of each of the bodies 94 of posts 90 so as to be positioned one adjacent each corner of the housing 14. The access openings 120 are sized to permit the entry of the screws 116 subsequent to the flanges 92 of posts 90 being received in each of the housing halves 16 and 18. Preferably the housing halves 16 and 18 are interconnected to each other as shown in FIG. 9 with the pairs of posts 90 entrapped therein. Thereafter the screws 116 will be disposed downwardly through the access opening 120 and aperture 96 to pass the smaller opening 108 and be threadedly received in the hole 86 to connect the posts 90 to the platen 42. A cap 124 illustrated in FIG. 10 will complete the assembly by being tightly received in the access opening 120 at the level of the deck 122 to provide a smooth deck surface. The caps 124 are removable with a suitable tool but being tight fitting will normally remain in position to close the opening 120. Since the post 90 were previously connected to the housing halves 16 and 18 and are now connected to the platen 42 the support assembly of the present invention is complete.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention, what is claimed herein is:

1. A resilient support system for a portable sander having an electric motor journaled in a housing comprising:

(a) a platen having a rigid back plate, (b) a plurality of bosses having raised top surfaces, hollow interiors and open bottoms formed on the back plate, (c) an aperture formed on each of the top surfaces in communication with the hollow interiors, (d) a solid pad formed of non-rigid material cemented to the bottom of the back plate and enclosing the open bottoms of each of the bosses, (e) a plurality of resilient posts having hollow interiors, extending between open tops and enclosed bottoms with central apertures therein to sit upon the top surface of the boss, (f) a plurality of screws, one inserted into each of the posts to pass through the aperture and be threadedly received into the aligned aperture of the boss whereby the screw extends into the hollow interior without contacting the pad, (g) the posts connected to the housing at the upper end thereof to resiliently support the platen, and (h) the platen connected to be driven by the electric motor.

2. The combination claimed in claim 1 wherein:

(a) the post has an effective length of substantially twice that of the boss.

3. The combination claimed in claim 1 wherein:

(a) an annular shoulder formed on the top surface of the boss below a raised central portion, and (b) an annular flange projecting downwardly from the bottom of the posts whereby the post flange sits upon the boss shoulder and the post nests upon the boss when connected thereto by the screw.

4. The combination claimed in claim 1 wherein:

(a) the back plate of the platen is formed of a rigid plastic material, and (b) the post is formed of a resilient plastic material.

* * * * *